US009127876B2

(12) United States Patent
Wilson et al.

(10) Patent No.: US 9,127,876 B2
(45) Date of Patent: Sep. 8, 2015

(54) SNAP OFF CENTER FLIPPER MULLION

(71) Applicant: Electrolux Home Products, Inc., Charlotte, NC (US)

(72) Inventors: Joshua Wilson, Seneca, SC (US); Paul Hayward Kelly, Anderson, SC (US); Wesley King, Anderson, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 0 days.

(21) Appl. No.: 13/827,954

(22) Filed: Mar. 14, 2013

(65) Prior Publication Data

US 2014/0265804 A1 Sep. 18, 2014

(51) Int. Cl.
*A47B 96/04* (2006.01)
*F25D 23/02* (2006.01)

(52) U.S. Cl.
CPC ..... *F25D 23/02* (2013.01); *F25D 23/028* (2013.01); *F25D 2323/021* (2013.01)

(58) Field of Classification Search
USPC ..... 312/326, 329, 405, 407; 16/252, 332, 16/334, 335, 262, 263
See application file for complete search history.

(56) References Cited

U.S. PATENT DOCUMENTS

| | | | | | |
|---|---|---|---|---|---|
| 987,467 | A | | 3/1911 | Katzenberger | |
| 2,999,268 | A | * | 9/1961 | Strandengen | 16/332 |
| 4,244,081 | A | | 1/1981 | Beyer et al. | |
| 4,428,096 | A | | 1/1984 | Kaspar | |
| 4,645,371 | A | * | 2/1987 | Wang | 403/93 |
| 4,711,098 | A | | 12/1987 | Kuwabara et al. | |
| 4,854,009 | A | * | 8/1989 | Brockhaus | 16/263 |
| 5,411,328 | A | | 5/1995 | You | |
| 5,412,842 | A | * | 5/1995 | Riblett | 16/334 |
| 5,694,789 | A | | 12/1997 | Do | |
| 5,867,869 | A | * | 2/1999 | Garrett et al. | 16/252 |
| 5,918,347 | A | * | 7/1999 | Morawetz | 16/322 |
| 6,163,929 | A | * | 12/2000 | Bradley | 16/380 |
| 6,519,811 | B1 | * | 2/2003 | Cheng | 16/252 |
| 6,609,273 | B1 | * | 8/2003 | Yamada et al. | 16/332 |
| 6,766,561 | B1 | * | 7/2004 | Cheng | 16/235 |
| 7,008,032 | B2 | | 3/2006 | Chekal et al. | |
| 7,010,832 | B2 | * | 3/2006 | Chen | 16/252 |

(Continued)

FOREIGN PATENT DOCUMENTS

| | | | |
|---|---|---|---|
| EP | 2 169 335 | A2 | 3/2010 |
| WO | 2009/109878 | A1 | 9/2009 |

OTHER PUBLICATIONS

International Search Report issued in Application No. PCT/US2014/023187 dated Jun. 27, 2014.

(Continued)

*Primary Examiner* — Matthew Ing
(74) *Attorney, Agent, or Firm* — Pearne & Gordon LLP

(57) ABSTRACT

A refrigerator assembly includes a mullion assembly movably attached with respect to the refrigerator assembly. The mullion assembly includes a mullion portion defining a mullion recess. The mullion recess receives a biasing device for engaging a follower. A hinge assembly is attached to the mullion portion such that the mullion portion is movable with respect to the hinge assembly between a first position and a second position. The hinge assembly includes a first recess for receiving the follower when the mullion portion is in the first position. The hinge assembly further includes a second recess for receiving the follower when the mullion portion is in the second position.

20 Claims, 8 Drawing Sheets

(56) References Cited

U.S. PATENT DOCUMENTS

| | | | | |
|---|---|---|---|---|
| 7,228,596 | B2 * | 6/2007 | Kang | 16/330 |
| 7,917,994 | B2 * | 4/2011 | Bai | 16/252 |
| 2003/0115719 | A1 * | 6/2003 | Lee | 16/335 |
| 2005/0046319 | A1 | 3/2005 | Chekal | |
| 2008/0209812 | A1 | 9/2008 | Lancry et al. | |
| 2009/0179540 | A1 | 7/2009 | Seo | |
| 2009/0273264 | A1 | 11/2009 | Butler | |
| 2010/0071404 | A1 * | 3/2010 | Han et al. | 62/441 |
| 2012/0079682 | A1 * | 4/2012 | Cheng | 16/252 |

OTHER PUBLICATIONS

Written Opinion issued in Application No. PCT/US2014/023187 dated Jun. 27, 2014.

* cited by examiner

SNAP OFF CENTER FLIPPER MULLION

BACKGROUND

1. Field

The present invention relates generally to refrigerator assemblies, and, more particularly, to a refrigerator assembly having a mullion in attachment with a refrigerator door.

2. Description of Related Art

Various types of refrigerators include side by side doors ("French Door"). Refrigerators incorporating side by side doors may use a mullion assembly to improve a seal between the doors and refrigerator cabinet. In the past, magnets, such as Neodymium magnets, have been used to pull (e.g., flip) the mullion assembly between an opened and closed position. However, magnets can be expensive and relatively difficult to incorporate. As such, it would be beneficial to reduce the use of magnets in the mullion assembly.

BRIEF SUMMARY

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect, a refrigerator assembly is provided comprising a mullion assembly movably attached with respect to the refrigerator assembly. The mullion assembly includes a mullion portion defining a mullion recess, the mullion recess receiving a biasing device configured to movably engage a follower. A hinge assembly is attached to the mullion portion such that the mullion portion is movable with respect to the hinge assembly between a first position and a second position. The hinge assembly includes a first recess for receiving the follower when the mullion portion is in the first position. The hinge assembly further includes a second recess for receiving the follower when the mullion portion is in the second position.

In accordance with another aspect, a refrigerator assembly is provided comprising at least one door movably attached to a refrigerator cabinet. A mullion assembly is movably attached with respect to the at least one door. The mullion assembly includes a mullion portion defining a mullion recess, the mullion recess receiving a biasing device configured to movably engage a follower. A hinge assembly is attached to the at least one door and attached to the mullion portion such that the mullion portion is movable with respect to the hinge assembly between a first position and a second position. The hinge assembly includes a cam structure having a first recess for receiving the follower when the at least one door is in a closed position and a second recess for receiving the follower when the at least one door is in an opened position.

In accordance with another aspect, a mullion assembly includes a mullion portion defining a mullion recess extending from an outer surface of the mullion portion into an interior of the mullion portion. The mullion recess receives a follower configured to move with respect to the mullion recess. A hinge assembly attached to the mullion portion such that the mullion portion is movable with respect to the hinge assembly between a first position and a second position. The hinge assembly includes a first recess for receiving the follower when the mullion portion is in the first position. The hinge assembly further includes a second recess for receiving the follower when the mullion portion is in the second position.

BRIEF DESCRIPTION OF THE DRAWINGS

The foregoing and other aspects will become apparent to those skilled in the art to which the present examples relate upon reading the following description with reference to the accompanying drawings, in which.

DETAILED DESCRIPTION

Figure 1:
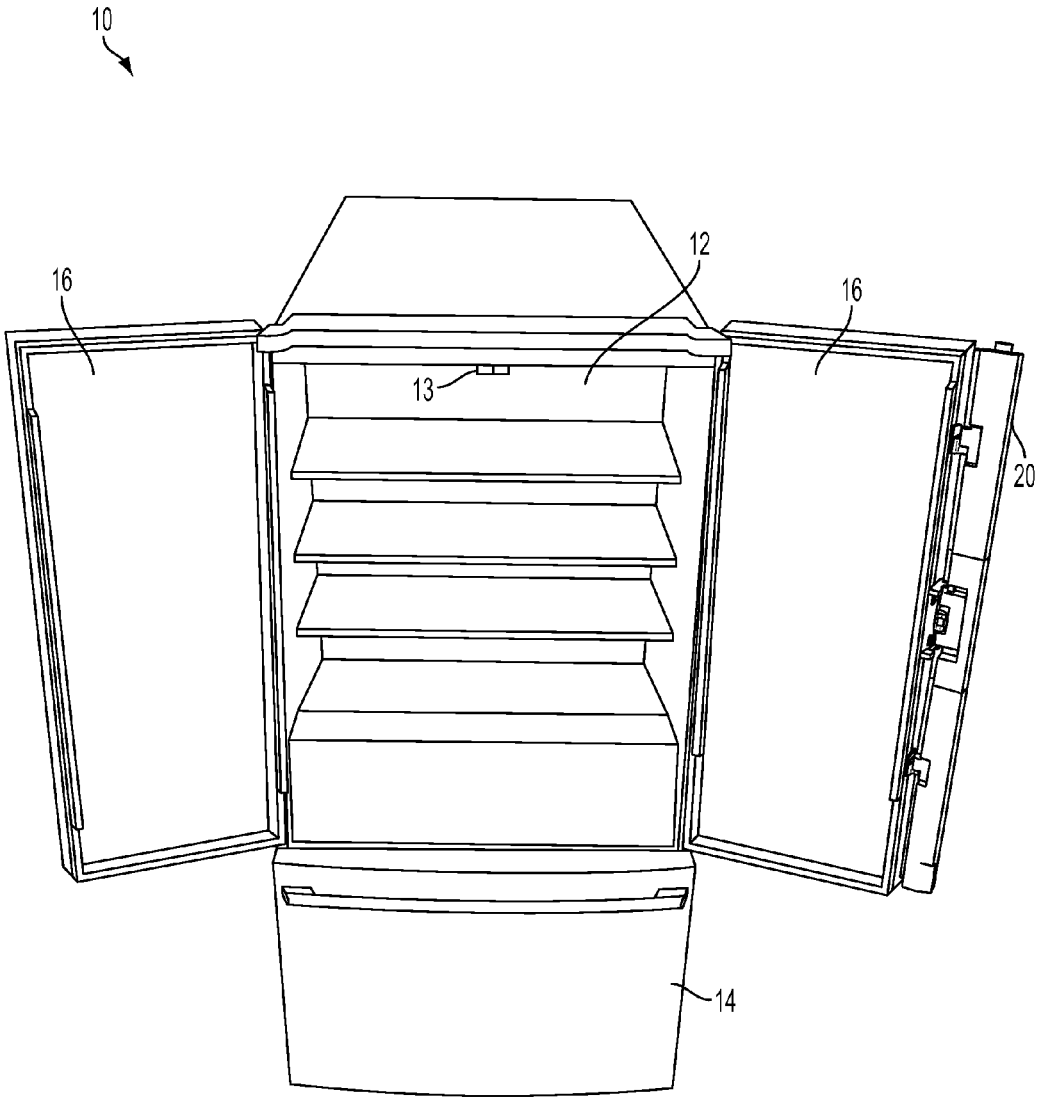
FIG. 1 is a perspective view of an example refrigerator assembly with an example mullion assembly.

Example embodiments that incorporate one or more aspects are described and illustrated in the drawings. These illustrated examples are not intended to be a limitation on the present examples. For example, one or more aspects can be utilized in other embodiments and even other types of devices. Moreover, certain terminology is used herein for convenience only and is not to be taken as a limitation on the present examples. Still further, in the drawings, the same reference numerals can be employed for designating the same elements.

Referring to the example of FIG. 1, an example of a refrigerator assembly 10 is shown. In short summary, the refrigerator assembly 10 includes one or more compartments, such as a fresh food compartment 12 and a freezer compartment 14. A mullion assembly 20 is provided in attachment with at least one door 16 for improved sealing. As will be described in detail below, the mullion assembly 20 is movable between a first (opened) and a second (closed) position. A hinge assembly has a cam surface to hold the mullion assembly 20 in either of the first or second positions.

The refrigerator assembly 10 shown in FIG. 1 comprises one possible example of a refrigerator assembly 10. In this example, the refrigerator assembly is a French door bottom mount freezer assembly. A French door bottom mount freezer assembly includes the fresh food compartment 12 provided at an upper portion of the refrigerator assembly 10. The freezer compartment 14 is provided at a lower portion and underneath the fresh food compartment 12. In further examples, the refrigerator assembly 10 could be provided with multiple compartments or with compartments located above and/or laterally with respect to one another. The refrigerator assembly 10 could further include a side by side fresh food compartment and freezer compartment, such that the refrigerator assembly 10 is not limited to the shown French door bottom mount freezer. In particular, the refrigerator assembly 10 includes the fresh food compartment 12 positioned laterally next to the freezer compartment 14. In yet another example, the refrigerator assembly 10 may include only a freezer compartment provided without the fresh food compartment or a fresh food compartment without the freezer compartment. Accordingly, it is to be appreciated that the refrigerator assembly 10 shown in FIG. 1 comprises only one possible example, as any number of designs and configurations are contemplated.

The refrigerator assembly 10 includes the fresh food compartment 12 maintained at a first temperature. The fresh food compartment 12 is somewhat generically depicted and defines a substantially hollow interior portion and may include shelves, drawers, or the like. The fresh food compartment 12 can include a pair of doors 16, such as French doors. It is to be appreciated, however, that the fresh food compartment 12 could include other door assemblies, and is not limited to having the French doors shown in FIG. 1. Rather, in further examples, the fresh food compartment 12 could include a single door, or the like. The refrigerator assembly 10 can further include the freezer compartment 14 positioned adjacent and underneath the fresh food compartment 12. The freezer compartment 14 can be maintained at a second temperature that is lower than the first temperature of the fresh food compartment 12.

The refrigerator assembly 10 can further include a guide element 13. The guide element 13 functions by engaging the mullion assembly 20 during opening and closing of the doors 16. The guide element 13 is shown to be positioned at an upper portion of the fresh food compartment 12. However, in further examples, the guide element 13 is not limited to the upper portion of the fresh food compartment 12, and instead could be positioned at a lower portion of the fresh food compartment 12, or at both the upper and lower portions. The guide element 13 is illustrated schematically, as it is understood that the guide element 13 includes any number of configurations. Indeed, the guide element 13 could be larger or smaller than as shown.

Figure 2:
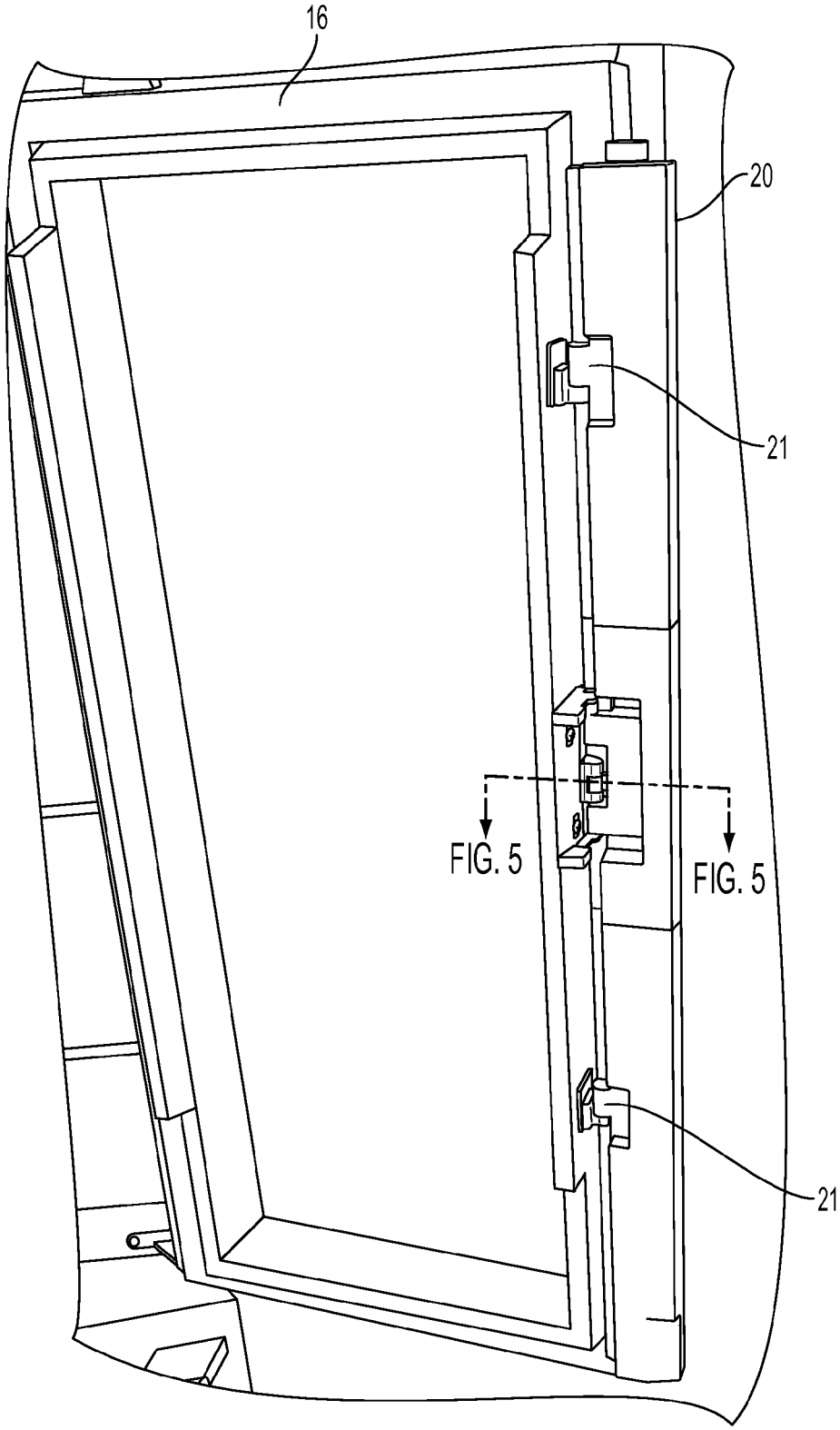
FIG. 2 is a perspective view of the refrigerator assembly having a door with the mullion assembly.
Figure 3:
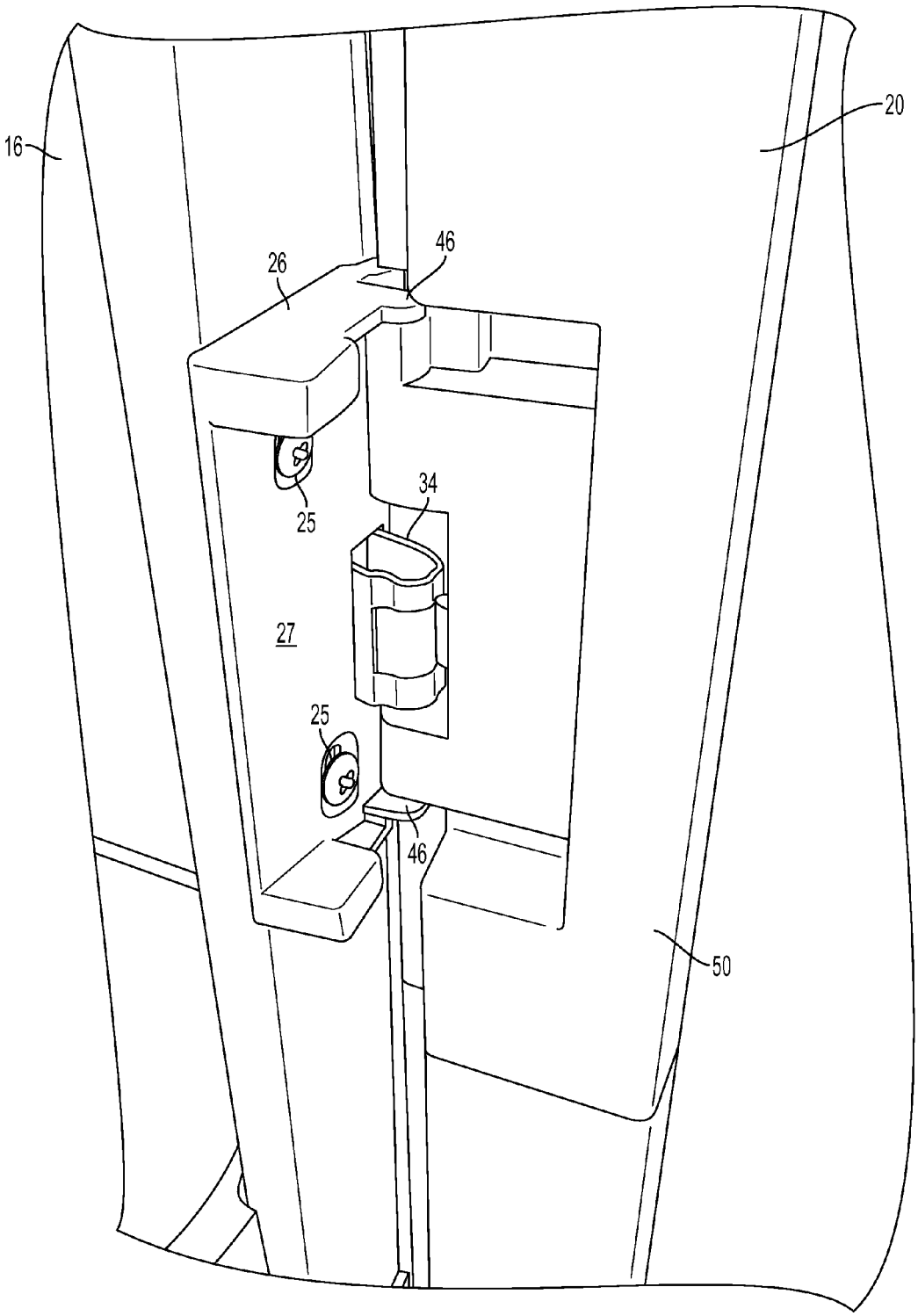
FIG. 3 is an enlarged view of the mullion assembly attached to the door.

Turning now to FIGS. 2 and 3, the refrigerator assembly 10 includes the mullion assembly 20. The mullion assembly 20 is attached to one of the doors 16, in particular, an edge of the door 16. The mullion assembly 20 is movable between a first (opened) position and a second (closed) position. For example, when the door 16 is in the opened position, the mullion assembly 20 will generally be in the first position, whereupon the mullion assembly 20 is arranged generally flush with an edge of the door. Conversely, when the door 16 is in the closed position, the mullion assembly 20 will likewise move to the second position, whereupon the mullion assembly 20 extends generally parallel to the door 16 (e.g., in a similar position as shown in FIG. 1). It is to be appreciated that the mullion assembly 20 is shown to be in the second position in FIGS. 2 and 3 for illustrative purposes and to more clearly depict portions of the mullion assembly 20 in spite of the door 16 being in the opened position. However, in operation, when the door 16 is in the opened position, the mullion assembly 20 will be arranged flush with the edge of the door 16.

As shown in FIG. 2, the door 16 and mullion assembly 20 can include one or more pivoting hinges 21. The pivoting hinges 21 can movably attach the mullion assembly 20 to the door 16. For example, the pivoting hinges 21 can allow for pivotable movement of the mullion assembly 20 with respect to the door 16. The pivoting hinges 21 can include any number of configurations. In the shown example, two pivoting hinges are depicted, however in further examples, the door 16 and mullion assembly 20 could be attached via one or more pivoting hinges 21. Further, the pivoting hinges 21 are not limited to the shown position, and in further examples, could be positioned closer to a top, bottom, or center portion along a length of the door 16. Either or both of the hinges 21 may or may not include cam structure.

Figure 4:
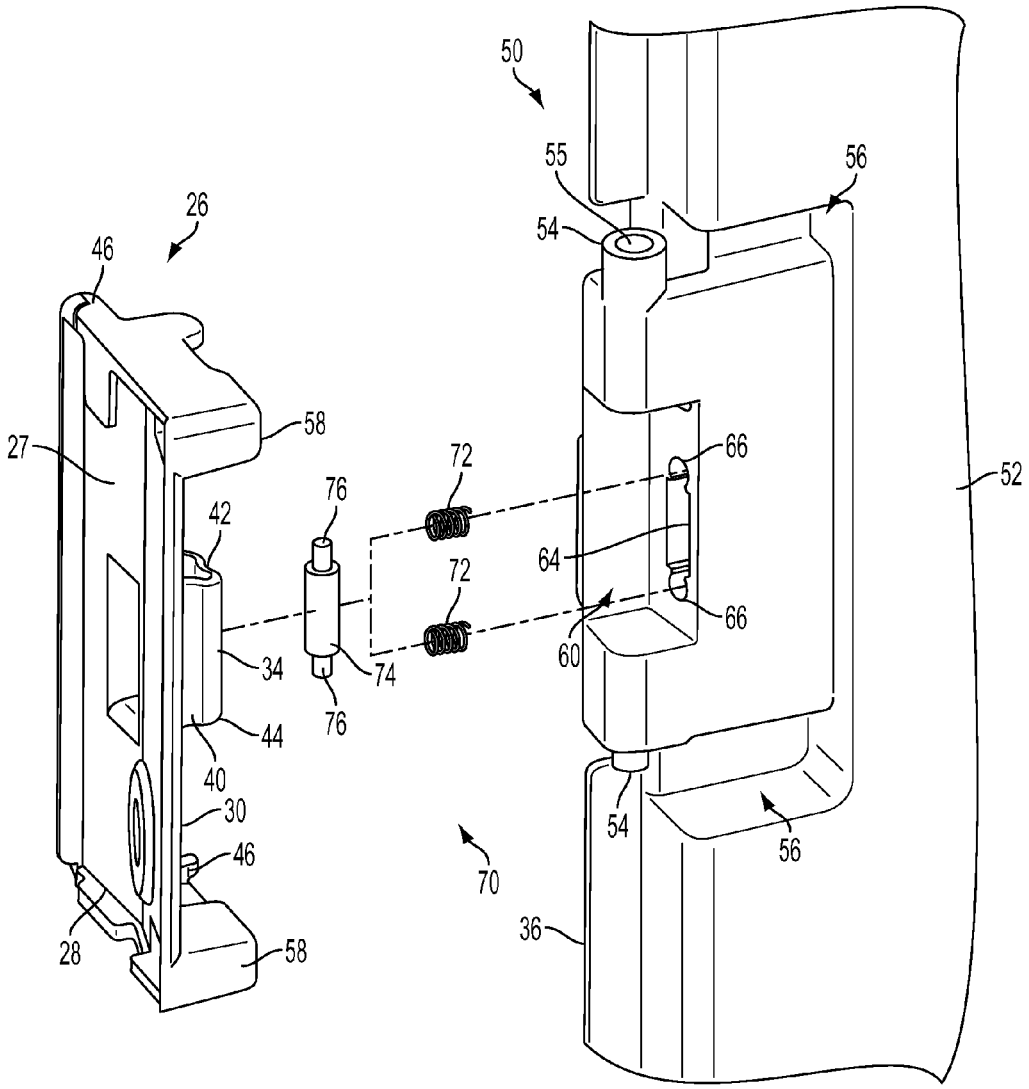
FIG. 4 is an exploded view of the mullion assembly.

Turning now to FIGS. 3 and 4, the mullion assembly 20 will now be described in more detail. The mullion assembly 20 is shown in an assembled state in FIG. 3 and in an exploded state in FIG. 4. It is to be appreciated that the mullion assembly 20 is depicted in the exploded state for illustrative purposes and to more clearly show portions of the mullion assembly 20. Moreover, the mullion assembly 20 is not shown in attachment with the door 16 in FIG. 4. However, in operation, the mullion assembly 20 will be in a fully constructed state as shown in FIGS. 1 to 3.

Referring now to FIG. 4, the mullion assembly 20 includes a hinge assembly 26. The hinge assembly 26 includes a hinge plate 27 that is elongated, generally planar and extends along the door 16. The hinge plate 27 has a first side 28 and an opposing second side 30. The first side 28 can be attached to the door 16. In one example, the first side 28 is arranged to be flush with an edge of the door 16 (as shown in FIG. 3). The hinge plate 27 can be attached to the door 16 with various types of fasteners 25 (also shown in FIG. 3), such as mechanical fasteners (screws, nuts, bolts, etc.), adhesives (epoxy, glue, etc.) or by a snap fit structure. While the hinge plate 27 is shown to be attached at substantially a midpoint vertical location of the door 16 (in FIG. 2), the hinge plate 27 could be positioned higher or lower in further examples.

The hinge assembly 26 includes a cam structure 34 positioned on the second side 30 of the hinge plate 27. The cam structure 34 defines an outwardly projecting protuberance extending from the second side 30. The cam structure 34 has a generally quadrilateral shaped cross-section with rounded edges. In further examples, the cam structure 34 can include a square shaped or rectangular shaped cross-section or the like.

The cam structure 34 includes one or more stop structures for controlling movement of the mullion assembly 20. The one or more stop structures can include, for example, a first recess 40 and a second recess 42. The stop structures are not so limited to including the recesses, and in further examples, the stop structures could include extensions, projections, openings, etc. The first recess 40 defines an inward recess extending towards an interior of the cam structure 34. The first recess 40 has an arcuate shape, though in further examples, the first recess 40 could have linearly extending portions, or the like. Likewise, the first recess 40 could be larger (e.g., projecting deeper into the cam structure 34) or smaller (e.g., projecting shallower into the cam structure 34) than as shown.

The one or more stop structures of the cam structure 34 further includes the second recess 42. The second recess 42 is positioned approximately 90° from the first recess 40. In further examples, however, the second recess 42 could be positioned at various other angles closer to or further from the second recess 42. The second recess 42 can have substantially the same size and shape as the first recess 40. For example, the second recess 42 defines an inward recess extending towards an interior of the cam structure 34. The second recess 42 has an arcuate shape, though in further examples, the second recess 42 could have linearly extending portions, or the like. Likewise, the second recess 42 could be larger (e.g., projecting deeper into the cam structure 34) or smaller (e.g., projecting shallower into the cam structure 34) than as shown.

The one or more stop structures of the cam structure 34 further includes a stopper 44. The stopper 44 is positioned at an edge of the cam structure 34 between the first recess 40 and second recess 42. The stopper 44 defines an outwardly projecting protuberance, such that the stopper 44 projects outwardly more than either of the first recess 40 or second recess 42. The stopper 44 can be rounded (as shown) or may include linearly extending portions.

The hinge assembly 26 further includes one or more attachment structures 46. The attachment structures 46 are positioned at opposing ends of the hinge plate 27. For example, the attachment structures 46 can be positioned at upper and lower ends of the hinge plate 27. In further examples, however, the attachment structures 46 are not limited to such a location, and could be positioned closer towards a center of the hinge plate 27. The hinge plate 27 in the shown examples includes two attachment structures, though in further examples, any number of attachment structures are envisioned (e.g., one or more). The attachment structures 46 project from the second side 30 in a direction away from the hinge plate 27. The attachment structures 46 can further include engagement structures, projections, or the like for movably (e.g., pivotably) attaching to another structure.

The mullion assembly 20 further includes a mullion portion 50. The mullion portion 50 includes an elongated mullion body 52 that extends along substantially the entire length of the door 16 (shown in FIG. 2). As will be described in more detail below, the mullion portion 50 is movably attached to the hinge assembly 26, such that the mullion portion 50 can movably seal the doors 16 when in the second position.

The mullion body 52 includes attachment portions 54 for attaching to the hinge assembly 26. The attachment portions 54 each extend in a direction along which the mullion body 52 extends. A distance between the attachment portions 54 can be slightly less than a distance between the attachment structures 46 of the hinge assembly 26, such that the attachment portions 54 can be received between the attachment structures 46. The attachment portions 54 each include an opening 55 for receiving a portion of the attachment structures 46. It is to be appreciated that only the opening 55 in the upper attachment structure is shown, since the opening 55 in the lower attachment structure is obstructed from view. The attachment portions 54 can allow for the mullion body 52 to move (e.g., pivot) with respect to the hinge assembly 26. The mullion assembly 20 is not limited to including the attachment structures 46 and the attachment portions 54. Instead, in further examples, the mullion assembly 20 could include any number of structures that allow for pivotable movement.

The mullion body 52 further includes a pair of channel openings 56. The channel openings 56 define a recess projecting into the mullion body 52. The channel openings 56 are bound on each side with walls of the mullion body 52. The channel openings 56 can extend generally parallel to each other in a direction that is substantially transverse to the direction along which the mullion body 52 extends. The channel openings 56 are spaced apart from each other and are sized/shaped to receive hinge protrusions 58 in the hinge assembly 26. Accordingly, the mullion portion 50 can move (e.g., rotate, pivot, etc.) with respect to the hinge assembly 26, such that when the mullion body 52 is flush with the hinge plate 27, the hinge protrusions 58 are received within the channel openings 56. This nesting of the hinge protrusions 58 within the channel openings 56 can ensure proper alignment of the mullion portion 50 with respect to the hinge assembly 26. It is to be understood that in further examples, the positions of the channel openings 56 and hinge protrusions 58 could be reversed, such that the channel openings 56 are disposed within the hinge assembly 26 while the hinge protrusions 58 are disposed on the mullion body 52.

The mullion portion 50 further includes a cavity 60. The cavity 60 defines an opening in the mullion body 52. The cavity 60 is positioned between the attachment portions 54 and extends generally parallel to the direction along which the mullion body 52 extends. The cavity 60 is bound on two adjacent sides by walls, though in further examples, the cavity 60 could be bound by only one wall on one side. The cavity 60 has a length that is at least as long as a length of the cam structure 34, such that the cavity 60 can receive the cam structure 34 within an interior of the cavity 60. The cavity 60 is also large enough to allow for the mullion portion 50 to move (e.g., pivot, rotate, etc.) while the cam structure 34 is positioned within the cavity 60.

The cavity 60 further includes a mullion recess 64. The mullion recess 64 projects from the cavity 60 into an interior of the mullion body 52. The mullion recess 64 is an elongate opening that extends in a direction that is parallel to the cavity 60 and mullion body 52. The mullion recess 64 includes rounded end portions 66 that define a generally circularly-shaped cross section, although various other geometries are contemplated. The end portions 66 are disposed at opposing ends of the mullion recess 64.

The mullion assembly 20 further includes one or more rotation structures 70. The rotation structures 70 allow for movement of the mullion portion 50 with respect to the hinge assembly 26. The rotation structures 70 include, for example, one or more biasing devices. The biasing devices 72 can comprise two springs that can provide a biasing force. The biasing devices 72 are sized and shaped to fit within the end portions 66 of the mullion recess 64. The biasing devices 72 are arranged to extend in a direction that is substantially transverse to the direction along which the mullion body 52 extends along the door 16. While only two springs are shown, it is to be appreciated that the biasing devices 72 could include as few as one spring, or a plurality of springs.

The rotation structures 70 further include a follower 74. The follower 74 is an elongated, cylindrically shaped structure extending in a direction that is generally parallel to the mullion body 52. The follower 74 is sized and shaped to fit at least partially within the mullion recess 64, such that the follower 74 is slightly smaller in dimension than the mullion recess 64. The follower 74 has a cross-sectional size that allows the follower to engage and be received within the first recess 40 and second recess 42. The follower 74 includes follower ends 76 that are arranged to project into the end portions 66 of the mullion recess 64. In operation, the biasing devices 72 can exert a force on the follower ends 76 to bias the follower 74 in a direction away from the mullion body 52 and towards the hinge assembly 26.

Figure 5:
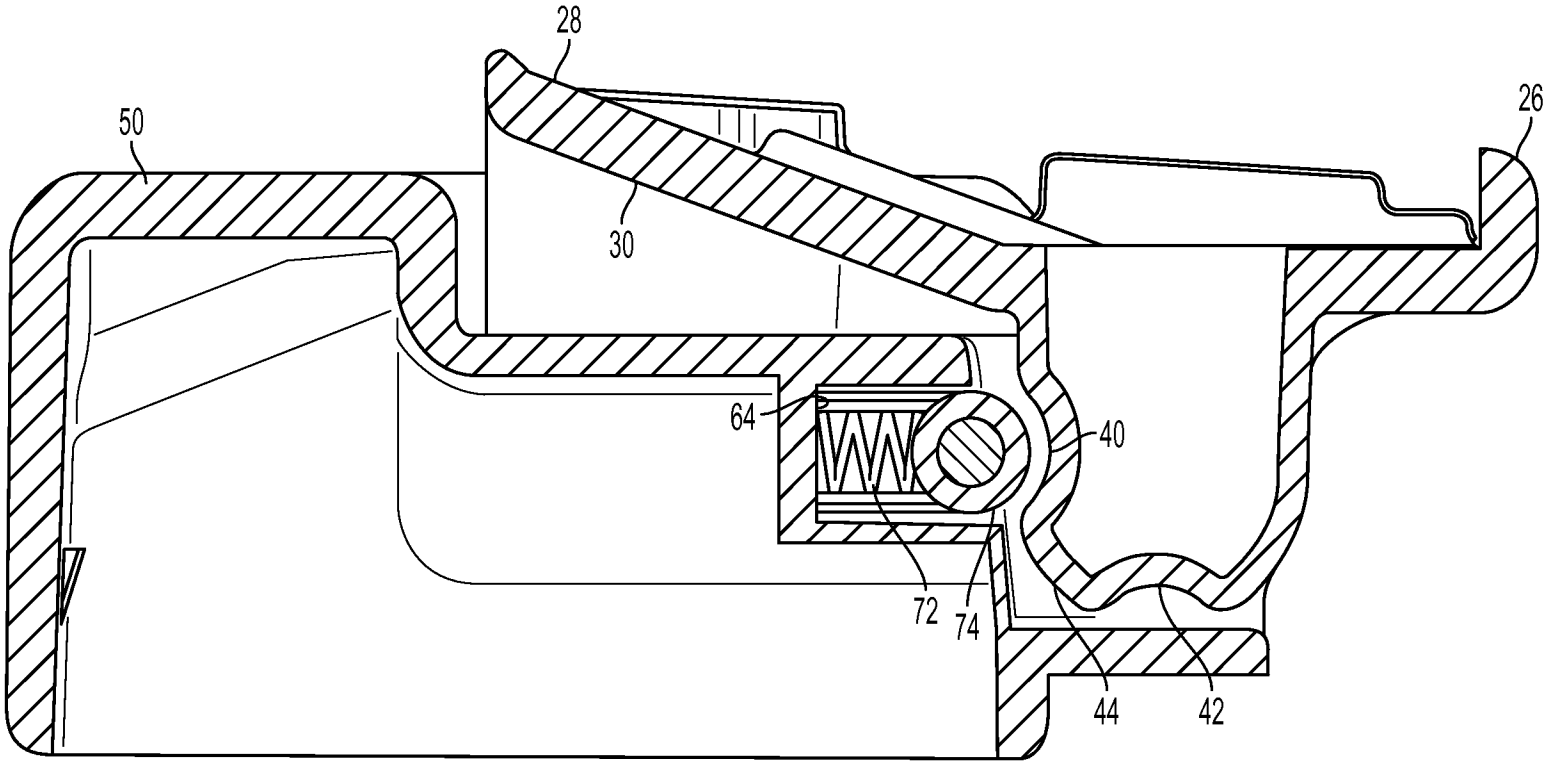
FIG. 5 is a sectional view of the mullion assembly along line 5-5 in FIG. 2 in which the mullion assembly is in the first position.

Turning now to FIG. 5, the operation of the mullion assembly 20 will now be described in detail. FIG. 5 depicts a cross-sectional view of the mullion assembly 20 taken from lines 5-5 of FIG. 2. It is to be appreciated that the mullion assembly 20 in this example is shown in a detached state from the door 16 for illustrative purposes and to more clearly show the interaction between the mullion portion 50 and hinge assembly 26. However, in operation, the mullion assembly 20 will be attached to the door 16 such that the mullion assembly 20 moves in response to the door 16 opening and closing. In particular, the first side 28 of the hinge assembly 26 will be attached to the door 16, in a similar manner as shown in FIGS. 2 and 3.

The mullion assembly 20 in FIG. 5 is depicted when the door 16 is in an opened position and the mullion portion 50 is flush with the hinge assembly 26. Initially, in this position, the biasing devices 72 are positioned within the mullion recess 64. Likewise, the follower 74 is positioned within the mullion recess 64 in contact with the biasing devices 72. The biasing devices 72 will engage the follower 74 and bias the follower 74 in a direction away from the biasing devices 72 (i.e., towards the first recess 40). Due at least in part to the rounded, arcuate shape of the follower 74, the follower will be received within and nest with the first recess 40 of the hinge assembly 26. This nesting between the follower 74 and first recess 40 will tend to cause the mullion portion 50 to remain in the position shown in FIG. 5 with respect to the hinge assembly 26. In particular, the biasing force of the biasing devices 72 is sufficient to hold the follower 74 in the first recess 40.

Figure 6:
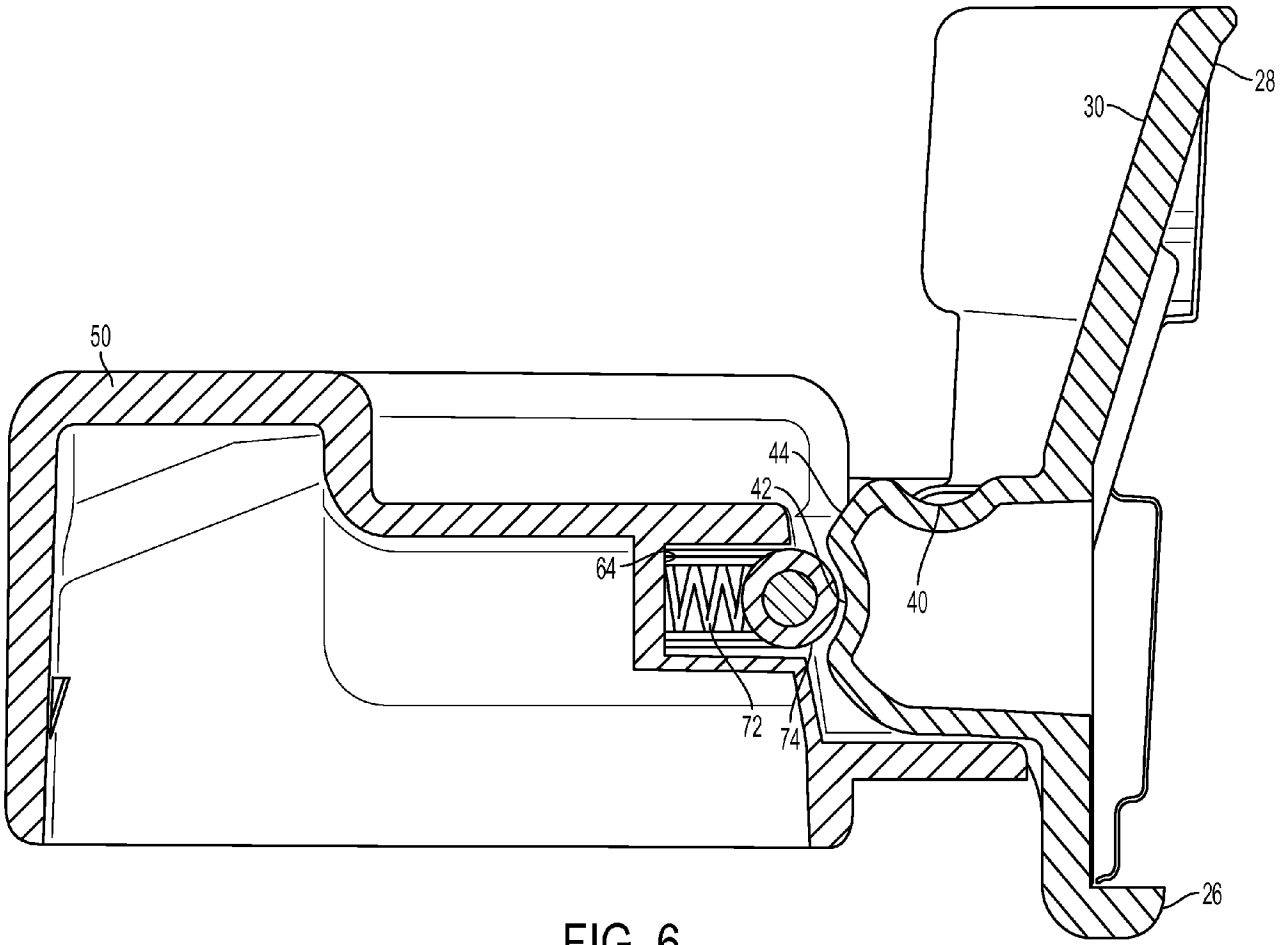
FIG. 6 is another sectional view of the mullion assembly similar to FIG. 5 in which the mullion assembly is in the second position.

Turning now to FIG. 6, the mullion assembly 20 can be moved to the second position. As the door 16 is closed, the mullion assembly 20 can engage the guide element 13 (shown in FIG. 1), which causes the mullion portion 50 to move from the first position (shown in FIG. 5) to the second position (shown in FIG. 6). The force of the engagement between the guide element 13 and the mullion portion 50 is sufficient to overcome the spring bias holding the follower 74 within the first recess 40. As such, the follower 74 will move (e.g., translate, etc.) from the first recess 40, over the stopper 44, and into the second recess 42. Once the follower 74 is moved to the second recess 42, the follower 74 will tend to cause the mullion portion 50 to remain in the position shown in FIG. 6 with respect to the hinge assembly 26. In particular, the biasing force of the biasing devices 72 is sufficient to hold the follower 74 in the second recess 42. By causing compression of the biasing devices 72 via the follower 74, the stopper 44 encourages the follower 74 into one of the recesses 40, 42.

By providing the rotation structures 70 including the biasing devices 72 and follower 74, the mullion assembly 20 can be held in position with respect to the hinge assembly 26 and door 16. In particular, the biasing devices 72 can hold the follower 74 in engagement with the first recess 40 and second recess 42. This engagement can limit the likelihood of the mullion assembly 20 inadvertently moving with respect to the hinge assembly 26 and door 16. Rather, movement of the mullion assembly 20 can be limited to when the mullion assembly 20 engages the guide element 13.

Figure 7:
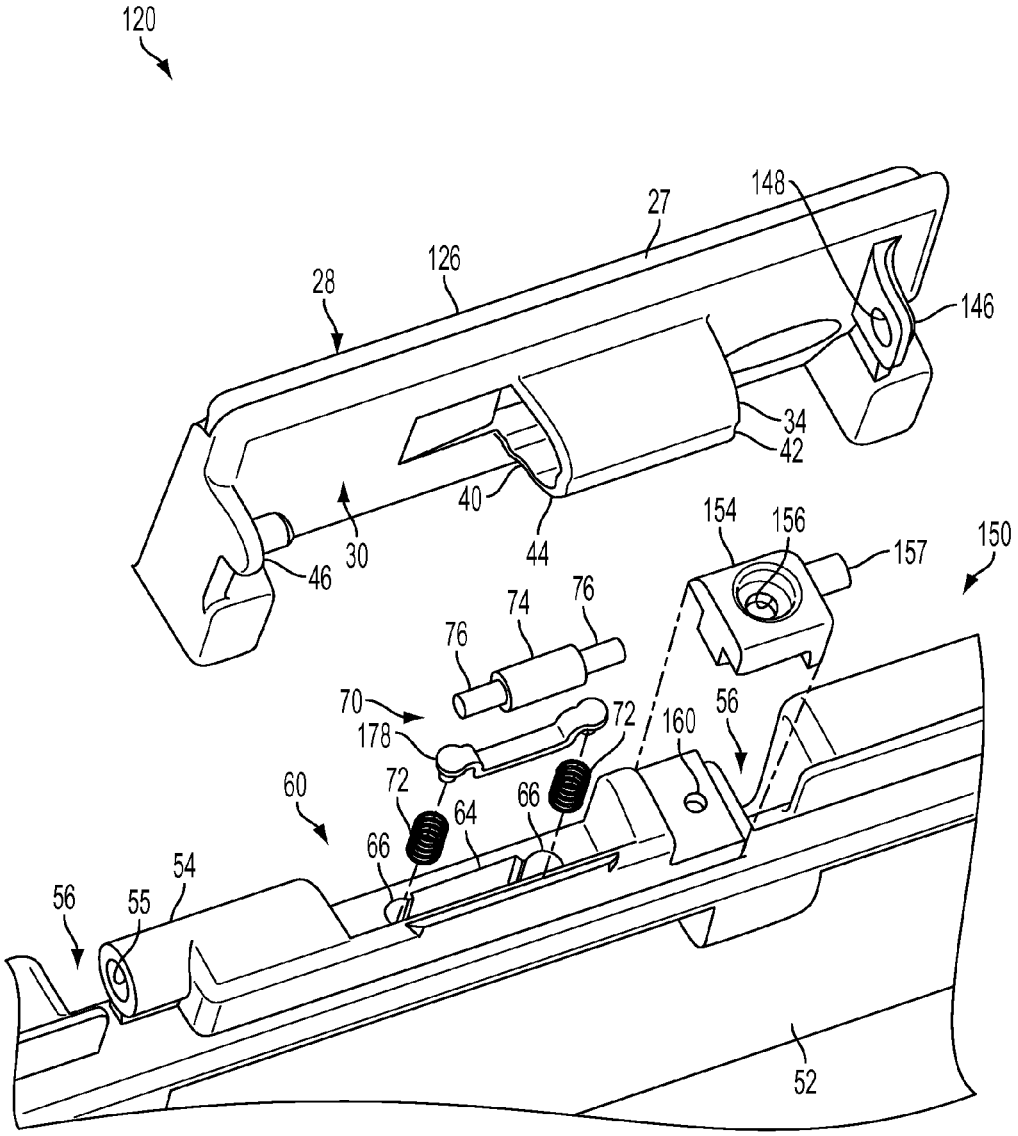
FIG. 7 is an exploded view of a second embodiment of an example mullion assembly.

Turning now to FIG. 7, an example of a second mullion assembly 120 is shown. In this example, a second hinge assembly 126 is similar to the hinge assembly 26 described above. In particular, the second hinge assembly 126 has the first side 28 and second side 30, with the first side 28 being attached to the door 16. Likewise, the cam structure 34 can be identical to the cam structure 34 described above, and includes the first recess 40, second recess 42, and stopper 44. In this example, the second hinge assembly 126 includes one attachment structure 46 (as opposed to the two attachment structures 46 described with respect to the hinge assembly 26). The one attachment structure 46 can be identical to the attachment structures 46 described above with respect to the hinge assembly 26.

The second hinge assembly 126 further includes an example second attachment structure 146 positioned generally opposite the attachment structure 46. The second attachment structure 146 projects from the second side 30 in a direction away from the hinge plate 27. The second attachment structure 146 is spaced apart a distance from the attachment structure 46. The second attachment structure 146 includes an opening 148 extending therethrough. In further examples, the second attachment structure 146 is not limited to including the opening 148 as shown, and instead could include a projection, protrusion, or the like.

The second mullion assembly 120 further includes a second mullion portion 150. The second mullion portion 150 includes similar structure to the mullion portion 50 described above. For example, the second mullion portion 150 includes the mullion body 52, channel openings 56, the cavity 60, mullion recess 64, and end portions 66. As such, these structures need not be described in detail again as they can be identical to the structures described above with respect to the mullion portion 50. In this example, the second mullion portion 150 includes one attachment portion 54 (as opposed to the two attachment portions 54 described above with respect to the mullion portion 50). The one attachment portion 54 can be identical to the attachment portions 54 described above with respect to the mullion portion 50.

The second mullion portion 150 further includes an example second attachment portion 154. The second attachment portion 154 is a separately formed structure that can be removably or non-removably attached to the mullion body 52. The second attachment portion 154 has a generally cuboid shape, though in further examples, can include any number of sizes, shapes, and configurations. The second attachment portion 154 further includes a projection 157 that projects outwardly in a direction away from the second attachment portion 154. In the shown example, the projection 157 extends along a direction that is parallel to the direction along which the mullion body 52 extends. The projection 157 is sized and shaped to be received by the opening 148 in the second hinge assembly 126. The second attachment portion 154 can further be removably attached to the mullion body 52. In particular, the second attachment portion 154 can include an opening 156 extending therethrough.

Figure 8:
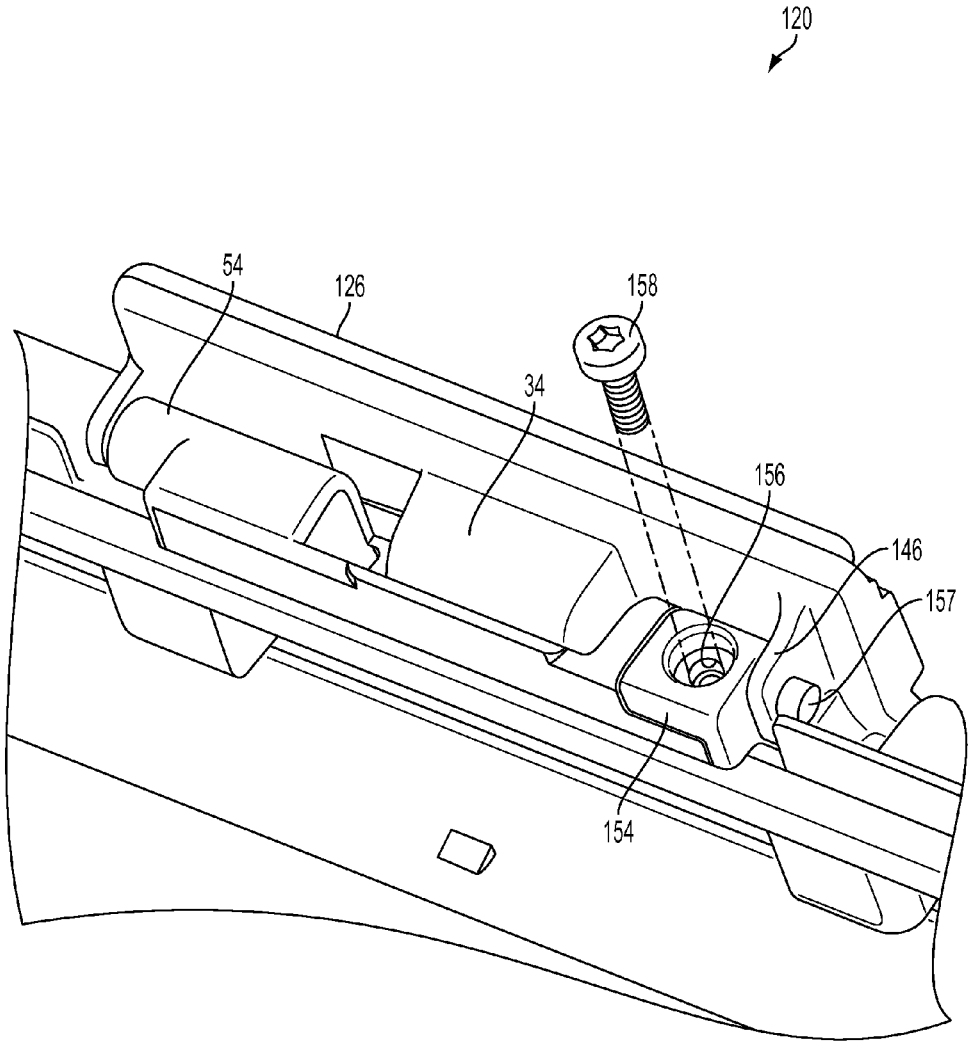
FIG. 8 is a partially exploded view of the second embodiment of the example mullion assembly.

The opening 156 can be sized and shaped to receive a fastener 158 (shown in FIG. 8). The fastener 158 can include various types of fastening structure, including screws, nuts, bolts, etc. The opening 156 is aligned with a mullion opening 160. The mullion opening 160 is positioned to extend at least partially into the mullion body 52. The mullion opening 160 is sized and shaped to engage the fastener 158. For example, if the fastener 158 is threaded (e.g., a screw), then the mullion opening 160 can likewise have a female threading that matches the threading of the fastener 158. As such, the fastener 158 can pass through the opening 156 in the second attachment portion 154 and into the mullion opening 160 to attach the second attachment portion 154 to the mullion body 52. Still, the attachment portion 152 can be removably or non-removably attached to the mullion body 52 in various other manners, including various mechanical fasteners, snap-fit structure, adhesives, welding, etc.

The second mullion assembly 120 further includes the rotation structures 70. In particular, the rotation structures 70 include the biasing devices 72 and follower 74 having follower ends 76. In addition, the rotation structures 70 include a spacing device 178. The spacing device 178 is positioned between the biasing devices 72 and the follower 74. The spacing device 178 is sized and shaped to fit within the mullion recess 64, and may include a projection or the like configured to engage the biasing device(s) 72. The spacing device 178 may further be configured to cooperate with the geometry of the follower 74, such as where the follower 74 includes varying geometry between a main portion of the follower 74 and the follower ends 76. In operation, the spacing device 178 can contact the biasing devices 72 on one side and can contact the follower 74 on an opposing second side. The spacing device 178 can limit/reduce particles (e.g., crumbs, debris, dust, etc.) from falling into the mullion recess 64. For example, the spacing device 178 can act as a stop from these particles from reaching the biasing devices 72 and impeding the biasing function (e.g., movability) of the biasing devices 72. The spacing device 178 can be made of a material different from that of the biasing devices 72 and follower 74. For example, the spacing device 178 can be made of a plastic material, while the biasing devices 72 and follower 74 can be made of metal materials. The plastic material of the spacing device 178 can provide a buffer between the biasing devices 72 and the follower 74 to inhibit, such as prevent, galvanic corrosion or the like when the biasing devices 72 and the follower 74 are made of different materials, such as different metals (e.g., steel and aluminum, etc.). Still, the various elements can also be made of the same or similar materials.

Turning now to FIG. 8, the second mullion assembly 120 is shown in a partially exploded view. In this example, the second attachment portion 154 is in contact and engagement with the mullion body 52. The projection 157 of the second attachment structure 146 is arranged to extend through the opening 148 in the second attachment structure 146. Opposite that end, the attachment structure 46 will engage the attachment portion 54. As such, the second mullion portion 150 is movably attached with respect to the second hinge assembly 126. Further, the follower 74 is biased by the biasing devices 72 in an identical manner as described above with respect to FIGS. 5 and 6. In particular, the follower 74 is biased into engagement with the first recess 40 (when the second mullion assembly 120 and door 16 are in the opened position) or the second recess 42 (when the second mullion assembly 120 and door 16 are in the closed position).

By providing the second attachment portion 154 as a separately attached structure to the second mullion portion 150, the second attachment portion 154 can be selectively attached and detached from the second mullion portion 150 (i.e., by removing the fastener 158). For example, the second hinge assembly 126 can includes one of a projection and an opening 148 (e.g., illustrated in FIG. 7) configured to receive the projection, and the second attachment portion 154 can include the other of the projection 157 (e.g., illustrated in FIG. 7) and the opening configured to receive the projection 157. Thus, the second attachment portion 154 can be removably attached to the mullion portion 150 to pivotally couple the mullion portion 150 to the second hinge assembly 126.

The second attachment portion 154 can therefore allow for relatively easier attachment and detachment of the second hinge assembly 126 to the second mullion portion 150. For example, one assembly method can include the steps of securing the second hinge assembly 126 to the refrigerator door 16, coupling the second attachment portion 154 to the second hinge assembly 126 (e.g., inserting the projection 157 into the opening 148), and finally securing the second attachment portion 154 to the mullion assembly 150 to thereby pivotally couple the mullion assembly 150 to the second hinge assembly 126. Additionally, the method can include the step of coupling the first attachment structure 46 of the hinge assembly 126 to the mullion portion 150 prior to securing the second attachment portion 154 to the mullion assembly 150. Additionally, the method can include the steps of inserting the biasing device 72 into the recess 66, engaging the biasing device 72 with the follower 74, and engaging the follower with the cam structure 34.

Moreover, the spacing device 178 can limit/reduce particles from falling into the mullion recess 64. It is to be appreciated that these features (e.g., second attachment portion 154, spacing device 178) are not limited to the second mullion assembly 120. Rather, the mullion assembly 20 shown and described above with respect to FIGS. 1 to 6 could likewise include either or both of the second attachment portion 154 and spacing device 178.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigerator assembly comprising:

a mullion assembly movably attached with respect to the refrigerator assembly, the mullion assembly including:

a mullion body defining a mullion recess, the mullion recess receiving a biasing device configured to engage a follower;

a hinge plate attached to the mullion body such that the mullion body is movable with respect to the hinge plate between a first position and a second position, the hinge plate including a first recess for receiving the follower when the mullion body is in the first position and a second recess for receiving the follower when the mullion body is in the second position, the hinge plate further including a first hinge attachment portion and a second hinge attachment portion;

a first mullion attachment portion pivotally coupling the mullion body to the hinge plate; and a second mullion attachment portion pivotally coupling the mullion body to the hinge plate, wherein the first hinge attachment portion comprises one of a first projection and a first opening and the first mullion attachment portion includes the other of the first projection and the first opening, wherein the first opening is configured to receive the first projection, wherein the second hinge attachment portion comprises one of a second projection and a second opening and the second mullion attachment portion includes the other of the second projection and the second opening, wherein the second opening is configured to receive the second projection, wherein the hinge plate is a single component that includes and the first and second hinge attachment portions, wherein the mullion body is another single component that includes the first mullion attachment portion, and wherein the second mullion attachment portion is removably attached to the mullion body.

2. The refrigerator assembly of claim 1, wherein the hinge plate includes a cam structure including the first recess and the second recess.

3. The refrigerator assembly of claim 1, wherein the second recess is positioned approximately 90° from the first recess, and a stopper is positioned between the first recess and second recess.

4. The refrigerator assembly of claim 1, wherein a shape of the follower substantially matches a shape of the first recess and the second recess such that the follower is removably received within the first recess and the second recess.

5. The refrigerator assembly of claim 1, wherein the mullion recess includes at least one rounded end portion disposed at an end of the mullion recess, the at least one rounded end portion receiving the biasing device.

6. The refrigerator assembly of claim 1, further including a spacing device positioned within the mullion recess.

7. The refrigerator assembly of claim 6, wherein the spacing device is positioned between the biasing device and the follower such that the biasing device engages one side of the spacing device and the follower engages an opposing second side of the spacing device.

8. The refrigerator assembly of claim 1, wherein the first and second projections extend in a direction that is substantially parallel to a direction along which the mullion portion extends.

9. The refrigerator assembly of claim 8, wherein the second hinge attachment portion comprises the second opening and the second mullion attachment portion comprises the second projection.

10. The refrigerator assembly of claim 1, wherein the second mullion attachment portion is removably attached to the mullion body with a fastener extending through a fastener opening in the second mullion attachment portion.

11. A refrigerator assembly comprising:

at least one door movably attached to a refrigerator cabinet; and a mullion assembly movably attached with respect to the at least one door, the mullion assembly including:

a mullion body defining a mullion recess, the mullion recess receiving a biasing device configured to movably engage a follower;

a hinge plate attached to the at least one door and attached to the mullion body such that the mullion body is movable with respect to the hinge plate between a first position and a second position, the hinge plate including a cam structure having a first recess for receiving the follower when the at least one door is in a closed position and a second recess for receiving the follower when the at least one door is in an opened position, the hinge plate further including a first hinge attachment portion and a second hinge attachment portion;

a first mullion attachment portion pivotally coupling the mullion body to the hinge plate; and a second mullion attachment portion pivotally coupling the mullion body to the hinge plate, wherein the first hinge attachment portion comprises one of a first projection and a first opening and the first mullion attachment portion includes the other of the first projection and the first opening, wherein the first opening is configured to receive the first projection, wherein the second hinge attachment portion comprises one of a second projection and a second opening and the second mullion attachment portion includes the other of the second projection and the second opening, wherein the second opening is configured to receive the second projection, wherein the hinge plate is a single component that includes the first and second hinge attachment portions, wherein the mullion body is another single component that includes the first mullion attachment portion, and wherein the second mullion attachment portion is removably attached to the mullion body.

12. The refrigerator assembly of claim 11, wherein a first side of the hinge plate is attached to the at least one door and a second side of the hinge plate is attached to the mullion body.

13. A mullion assembly comprising:

a mullion body defining a mullion recess extending from an outer surface of the mullion body into an interior of the mullion portion, the mullion recess receiving a follower configured to move with respect to the mullion recess; and a hinge plate attached to the mullion body such that the mullion body is movable with respect to the hinge plate between a first position and a second position, the hinge plate including a cam structure including a first recess for receiving the follower when the mullion body is in the first position, and a second recess for receiving the follower when the mullion body is in the second position, the hinge plate further including a first hinge attachment portion, and a second hinge attachment portion;

a first mullion attachment portion pivotally coupling the mullion body to the hinge plate; and a second mullion attachment portion pivotally coupling the mullion body to the hinge plate, wherein the first hinge attachment portion comprises one of a first projection and a first opening and the first mullion attachment portion includes the other of the first projection and the first opening, wherein the first opening is configured to receive the first projection, further wherein the second hinge attachment portion comprises one of a second projection and a second opening and the second mullion attachment portion includes the other of the second projection and the second opening, wherein the second opening is configured to receive the second projection, wherein the hinge plate is a single component that includes the first and second hinge attachment portions, wherein the mullion body is another single component that includes the first mullion attachment portion, and wherein the second mullion attachment portion is removably attached to the mullion body.

14. The mullion assembly of claim 13, wherein the second recess is positioned approximately 90° from the first recess, and a stopper is positioned between the first recess and second recess.

15. The mullion assembly of claim 13, further including a spacing device positioned within the mullion recess, the spacing device being positioned between a biasing device and the follower such that the biasing device engages one side of the spacing device and the follower engages an opposing second side of the spacing device.

16. The mullion assembly of claim 15, wherein the spacing device is positioned between a second biasing device and the follower such that the second biasing device engages one side of the spacing device and the follower engages an opposing second side of the spacing device.

17. The mullion assembly of claim 15, wherein the spacing device is made of a different material from that of the biasing device and the follower.

18. The mullion assembly of claim 17, wherein the spacing device is made of a plastic material and the follower is made of a metal material.

19. The mullion assembly of claim 13, wherein the mullion body comprises one of a channel opening and a protrusion configured to be received in the channel opening when the mullion body is in the first position, further wherein the hinge plate comprises the other of the channel opening and protrusion.

20. A mullion assembly comprising:

a mullion body defining a mullion opening and a mullion recess, the mullion recess receiving a biasing device configured to engage a follower; and a hinge plate attached to the mullion body such that the mullion body is movable with respect to the hinge plate between a first position and a second position, the hinge plate including a first recess for receiving the follower when the mullion body is in the first position, a second recess for receiving the follower when the mullion body is in the second position, wherein the hinge plate is a single component that includes a plate projection and a plate opening, wherein the mullion body is another single component that includes an attachment opening receiving the plate projection, and wherein the mullion assembly further comprises an attachment projection that is removably attached to the mullion body such that the attachment projection is received in the plate opening.

* * * * *